US010005114B2

(12) United States Patent
Christoforou

(10) Patent No.: US 10,005,114 B2
(45) Date of Patent: Jun. 26, 2018

(54) WORK ROLL COOLING APPARATUS AND METHOD

(71) Applicant: Primetals Technologies Austria GmbH, Linz (AT)

(72) Inventor: Peter Christoforou, Sheffield (GB)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 0 days. days.

(21) Appl. No.: 15/561,578

(22) PCT Filed: Mar. 3, 2016

(86) PCT No.: PCT/EP2016/054593
§ 371 (c)(1),
(2) Date: Sep. 26, 2017

(87) PCT Pub. No.: WO2016/162148
PCT Pub. Date: Oct. 13, 2016

(65) Prior Publication Data

US 2018/0085802 A1 Mar. 29, 2018

(30) Foreign Application Priority Data

Apr. 10, 2015 (GB) ..... 1506099.9

(51) Int. Cl.
*B21B 27/10* (2006.01)

(52) U.S. Cl.
CPC ..... *B21B 27/10* (2013.01); *B21B 2027/103* (2013.01); *B21B 2203/12* (2013.01)

(58) Field of Classification Search
CPC ..... B21B 27/10; B21B 27/08; B21B 45/0209; B21B 2027/103; B21B 2203/12
(Continued)

(56) References Cited

U.S. PATENT DOCUMENTS 4,061,010 A 12/1977 Stock et al. ..... 72/201
4,422,318 A * 12/1983 Christ ..... B21B 27/10 72/200

(Continued)

FOREIGN PATENT DOCUMENTS

EP 1 147 828 A1 10/2001
EP 2 489 446 A1 8/2012

(Continued)

OTHER PUBLICATIONS

International Search Report dated Jun. 13, 2016 in corresponding PCT International Application No. PCT/EP2016/054593.

(Continued)

*Primary Examiner* — David B Jones
(74) *Attorney, Agent, or Firm* — Ostrolenk Faber LLP

(57) ABSTRACT

A work roll cooling apparatus for a rolling mill includes: at least one chock (200) which is configured to support a work roll (100) in the rolling mill. The work roll (100) has an axis (X) about which it is rotatable. A shroud (300) so positioned adjacent the work roll rolling surface (100*a*) when the roll is in use to provide a cooling space within which a coolant is brought into contact with the work roll (100). The shroud includes a first part (301) disposed on the chock (200) to provide a predetermined gap (G) between the first part (301) and the work roll (100), a second part (302), and a connection for releasably connecting the first and second parts (301, 302). In a connected condition, the first and second parts (301, 302) are joined to provide the cooling space within the shroud (300), and in a disconnected condition, each of the at least one chock (200), the first part (301) of the shroud (300) and the work roll (100) may be axially removed from the rolling mill and the second part (301) of the shroud (300).

17 Claims, 2 Drawing Sheets

(58) Field of Classification Search
USPC ..... 72/201
See application file for complete search history.

(56) References Cited

U.S. PATENT DOCUMENTS

| | | | | |
|---|---|---|---|---|
| 4,653,303 | A * | 3/1987 | Richard | B21B 27/10 118/227 |
| 4,934,444 | A * | 6/1990 | Frischknecht | B21B 27/08 164/428 |
| 5,046,347 | A * | 9/1991 | Crosato | B21B 27/10 72/201 |
| 5,473,924 | A * | 12/1995 | Collinson | B21B 27/10 72/236 |
| 6,385,989 | B1 * | 5/2002 | Cassidy | B21B 27/10 62/373 |
| 6,499,328 | B2 | 12/2002 | Faggiani et al. | 72/201 |
| 8,978,437 | B2 | 3/2015 | Malas et al. | 72/201 |
| 9,427,788 | B2 * | 8/2016 | Dauphinais | B21B 27/10 |
| 2002/0162374 | A1 * | 11/2002 | Plicht | B21B 45/0209 72/201 |
| 2016/0303626 | A1 | 10/2016 | Malas et al. | |
| 2017/0175255 | A1 * | 6/2017 | Rattunde | C23C 14/542 |

FOREIGN PATENT DOCUMENTS

| | | | |
|---|---|---|---|
| EP | 2 881 186 | A1 | 6/2015 |
| JP | S63-303609 | A | 12/1988 |
| WO | WO 2012/110241 | A1 | 8/2012 |

OTHER PUBLICATIONS

Written Opinion dated Jun. 13, 2016 in corresponding PCT International Application No. PCT/EP2016/054593.

Combined Search and Examination Report dated Jul. 6, 2015 in corresponding United Kingdom Patent Application No. GB 1506099.9.

* cited by examiner

WORK ROLL COOLING APPARATUS AND METHOD

CROSS-REFERENCE TO RELATED APPLICATIONS

The present application is a 35 U.S.C. §§ 371 national phase conversion of PCT/EP2016/054593, filed Mar. 3, 2016, which claims priority of United Kingdom Patent Application No. 1506099.9, filed Apr. 10, 2015, the contents of which are incorporated by reference herein. The PCT International Application was published in the English language.

TECHNICAL FIELD

The present invention relates to work roll cooling apparatus for a rolling mill and to a method of operating the work roll cooling apparatus.

TECHNICAL BACKGROUND

Conventional aluminium cold rolling mills typically use kerosene as a coolant. This contains a small amount of lubricant also. The kerosene is sprayed onto the rollers using a spray bar including a number of nozzles. Thousands of liters are used to cool the rollers, which heat up due to work input into the aluminium by the rollers. The kerosene is recirculated through a filter system and is cooled to about 40 degrees Celsius. It nonetheless poses a significant fire risk. Fires may be extinguished by CO2 systems, but these need to be large and are expensive.

Water is an attractive coolant because it poses no fire risk and has good specific heat properties. However, water left in contact with aluminium damages the "mirror" finish of the aluminium, causing local corrosion, particularly if it gets trapped in the rolled foil.

An alternative coolant is liquid nitrogen (LN2). This cannot be recycled. But, on a large scale it is sufficiently inexpensive. LN2 has an advantage in that it separates the cooling medium from the lubrication medium. In comparison, kerosene with lubricant included cannot achieve this. When rolling thin films (e.g. 0.1 millimeters or less), the viscosity of the lubricant has a major impact on the speed of rolling that is possible. This is because the thickness of a lubrication film between the rolls and the strip being rolled is determined by a hydrodynamic effect. The rollers contact each other outboard of the strip width and the foil actually deforms the rollers in use. The actual foil thickness is controlled by the speed of rolling and the lubricant viscosity (remembering the rolls actually contact each other in the absence of the foil). This effect is highly significant in thin foils. So for thin foils, it is preferable to use low viscosity lubricant. For thicker material, high viscosity is better because this helps to maximize the "reduction" through the mill bite. Kerosene does not allow this control because the lubricant is incorporated into the coolant.

LN2 cooling tends to cause water to condense out of the air. Hence, a shroud is needed. An example of an arrangement including a shroud is disclosed in WO-2012/110241. Inside the shroud only nitrogen is present. However, it is also necessary to warm the shroud (for example, electrically or using a gas within the shroud) to ensure there is no condensation on the outside of the shroud which could get into the mill. A difficulty with the use of such a system is how to "seal" the shroud against the rotating roll. It is not possible to have physical contact between them because any contact (e.g. rubber) would damage the mirror surface of the foil. So a gas curtain or an air knife type effect is used. It has been found that a gap between the shroud and the roll has to be about 1 to 2 millimeters to ensure an effective seal with acceptable gas consumption. The roll length is about two meters, and the shroud is only supported at each end of the roll and so it is difficult to achieve accurate tolerances for this gap across the full length which can upset the effectiveness of the gas curtain.

Rollers need to be changed quite often. This involves the rollers generally being retracted axially out of the mill as a pair. The rollers are mounted in "chocks" and the whole chock system with rollers is removed. A problem is that a shroud, which, due to tolerances, must be mounted to the chocks, is too big to be retracted from the mill along with the rollers. Moreover, there is not much room to maneuver in the vicinity of the shroud because there may be thickness and flatness detectors in the way, along with "bend blocks" which are used to change the orientation of the rolls by adjusting the chock positions. Even if the shroud could be so removed, it would still be necessary for all the gas lines to be reconnected.

The present invention has a goal of alleviating at least to some extent one or more of the problems of the prior art.

DESCRIPTION OF THE INVENTION

According to an aspect of the invention, there is roll cooling apparatus for a rolling mill. The apparatus comprises: at least one chock which is configured to support a work roll in the rolling mill. The work roll is encircled by a rolling surface. The work roll has an axis about which it is rotatable. A shroud is positioned adjacent the rolling surface when the work roll is in use so as to provide a cooling space between the shroud and the rolling surface of the work roll within which a coolant is brought into contact with the work roll. The shroud includes a first part disposed on the chock to provide a predetermined gap between the first part and the rolling surface of the work roll, a second part, and a connection for releasably connecting the first and second parts. In a connected condition, the first and second parts are joined to provide the cooling space within the shroud. In a disconnected condition, each of the at least one chock, the first part of the shroud and the work roll may be axially removed from the rolling mill and from the second part of the shroud.

In use, the gap, between the first part of the shroud and the rolling surface of the work roll, provides a gas seal with the rolling surface. As explained below, the size of the gap is important for effective operation of the rolling mill. But, in a conventional rolling mill, consistency of the size of the gap may be lost when the work rolls are removed for repairs or cleaning. The invention herein solves this problem by keeping the sealing mechanism (the first part of the shroud) attached to the work roll chock and by removing the sealing mechanism and chock in order for the work roll to exit the mill. The two-part construction of the shroud beneficially enables the "front" part of the shroud to be of (radial) dimension small enough to allow the chock, work rolls and front part of the shroud to be replaced by removing them axially. To achieve this, the "rear" part of the shroud is configured to be disconnected from the front part. The seal between the front and rear parts may be gas tight but does not require the fine tolerance needed for the front part-to-work roll separation distance to be achieved along the work roll. Accordingly, each time a new or repaired work roll (or set of work rolls) is installed and the shroud is positioned back in the working position, the alignment of the shroud with the work roll is as good as possible. Moreover, when removing the work roll there is no need to manually disconnect the liquid, gas and power supply to the spray bar and shroud because these can remain connected to the second part of the shroud. By using the claimed apparatus, a roll change takes only about 5 to 10 minutes.

A further advantage of the split shroud is that, with the rear part disconnected from the front part, the front part can be cleaned, for example in the event that there is a build-up of debris such as lubricant mixed with small pieces of aluminium due to the rolling. It is also possible to clean the rolling surface of the work roll and/or the inside of the rear part of the shroud, if this is necessary. Furthermore, the front part of the shroud can be used to mount additional equipment, such as cleaning sprays or strippers.

The first part of the shroud may be disposed on the chock so as to be in fixed relationship with the work roll when in use.

The second part of the shroud may be arranged to be retracted from the first part, in a radial direction away from the axis of the work roll, in order to provide the disconnected condition.

The connection may comprise a compression seal, a pneumatic seal, or a hydraulic seal. The compression seal, pneumatic seal, or hydraulic seal may be disposed on the first part, the second part, or both of the first and second parts, of the shroud. When the compression seal, pneumatic seal, or hydraulic seal is disposed on both of the first and second parts of the shroud, the compression seal, pneumatic seal, or hydraulic seal may have complementary geometry between the first and second parts for guiding the first and second parts into the connected condition.

The first or second part of the shroud may include an exhaust for removing the coolant from the cooling space.

The shroud may comprise a heating arrangement for maintaining the outside of the shroud above a predetermined temperature. The heating arrangement may comprise a duct configured to receive a warming gas. The duct may be provided in the first part, the second part, or both of the first and second parts, of the shroud. When the duct is comprised in both of the first and second parts of the shroud, the second part may include an inlet for passing the warming gas into the duct from a first outside source. The first part may include an inlet for passing the warming gas into the duct from the first outside source or a second outside source.

The work roll cooling apparatus may include a removable cover which is arranged to prevent contamination of the second part of the shroud when the shroud is in the disconnected condition.

According to another aspect of the invention, there is a shroud for the work roll cooling apparatus as described above.

According to another aspect of the invention, there is a rolling mill, comprising at least one work roll and work roll cooling apparatus as described above.

According to another aspect of the invention, a method of operating a work roll cooling apparatus for a rolling mill, comprises: configuring at least one chock to support a work roll in the rolling mill, the work roll having an axis about which it is rotatable and an encircling rolling surface; disposing on the at least one chock a first part of a shroud adjacent the work roll so as to provide a predetermined gap between the first part and the rolling surface of the work roll; axially inserting each of the at least one chock, the first part of the shroud and the work roll into the rolling mill; releasably connecting a second part of the shroud to the first part such that the first and second parts are joined to thereby provide a cooling space within the shroud into which a coolant may be brought for contacting the work roll; and also disconnecting the second part of the shroud from the first part; and axially removing each of the at least one chock, the first part of the shroud and the work roll from the rolling mill and from the second part of the shroud.

Disposing the at least one chock on the first part of the shroud may comprise defining a fixed relationship between the first part and the work roll when in use.

Axially removing each of the at least one chock, the first part of the shroud and the work roll from the rolling mill and from the second part of the shroud may comprise retracting the second part from the first part of the shroud, radially away from the axis of the work roll.

Embodiments will now be described, by way of example, with reference to the accompanying figures in which:

DESCRIPTION OF AN EMBODIMENT

Figure 1:
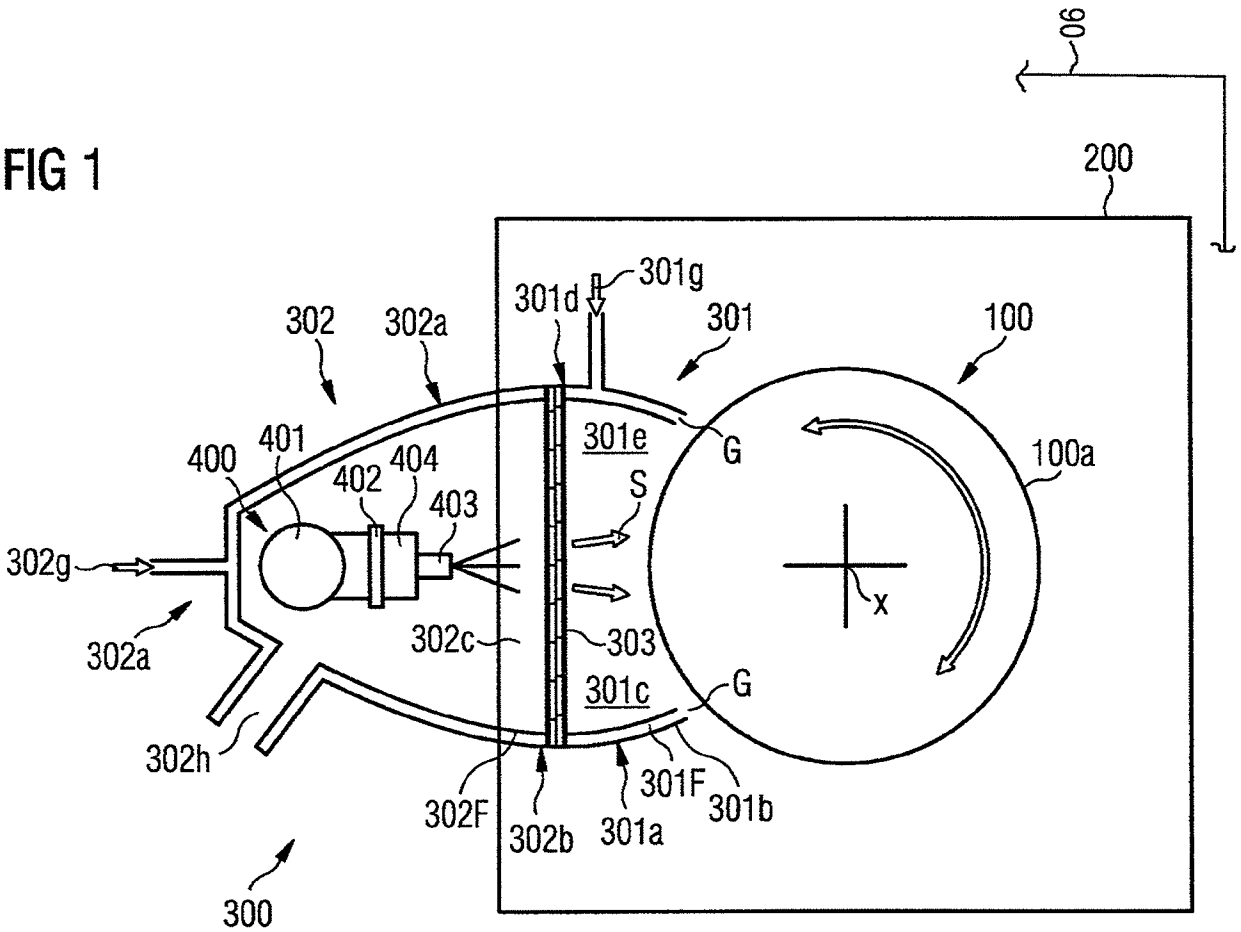
FIG. 1 shows a simplified sectional view of the inventive work roll cooling apparatus in a connected condition.

Referring to FIG. 1, an elongate work roll 100 for an aluminium rolling mill 90 has a longitudinal axis X, about which the work roll 100 can rotate, and a curved rolling surface 100*a*. The work roll 100 is supported by a pair of rectangular blocks, or chocks 200 (only one of which is shown) which are configured to be installed in the rolling mill 90, along with a further work roll and further pair of chocks (not shown), such that the two work rolls together form a mill bite for rolling aluminium foil.

An elongate shroud 300 is located adjacent the work roll 100 and extends longitudinally in generally parallel relationship with the work roll 100. The shroud 300 comprises a forward, sleeve-like part 301 and a rearward, closure part 302, the two parts 301, 302 being detachably coupled together.

The forward, sleeve-like part 301 of the shroud 300 comprises a curved shell 301*a* having a peripheral front edge 301*b* which defines an opening, or mouth 301*c*, which faces the curved rolling surface 100*a* of the work roll 100. At the other end of the sleeve-like part 301 a peripheral rear edge 301*d* of the shell 301*a* defines an opening 301*e*. The sleeve-like part 301 is removably attached to a side of each chock 200 (only one chock being visible in FIG. 1) such that a small gap G is provided between the peripheral front edge 301*b* and the curved rolling surface 100*a*. The size of the gap G is determined according to the requirements of a given rolling operation and may be set by operators using visual inspection or measuring instruments when the sleeve-like part 301 has been attached to the chocks 200. The mounting to the chock 200 may be arranged to enable the sleeve-like part 301 part to be adjustable relative to the chock 200, to aid in setting the correct position of the sleeve-like part 301 to achieve the desired gap G, and further arranged so that the sleeve-like part 301 can be attached to the chock 200 so that the sleeve-like part 301 is held in fixed relationship with the chock 200 when the rolling mill 90 is in use.

In this embodiment, the shell 301*a* of the sleeve-like part 301 includes a double wall which defines a duct 301*f* that extends from the peripheral rear edge 301*d* to the peripheral front edge 301*b*, and an inlet 301*g* which extends into the duct 301*f*. The inlet 301*g* is connectable to a first gas source (not shown).

The rearward, closure part 302 of the shroud 300 comprises a curved shell 302*a* having a peripheral front edge 302*b* which defines an opening 302*c* and is configured to match the size and shape of the peripheral rear edge 301*d* of the shell 301*a* of the sleeve-like part 301. At the other end of the closure part 302 the curved shell 302*a* transitions into a flat, closed rear end 302*e*.

In this embodiment, the shell 302*a* of the closure part 302 includes a double wall which defines a duct 302*f* that extends rearwardly from the peripheral front edge 302*b*, and an inlet 302*g* which extends into the duct 302*f*. The inlet 302*g* is connectable to the first gas source and/or a second gas source (not shown) which is configured to supply a gas to the duct 302*f*. The closure part 302 also includes an outlet 302*h*.

In this embodiment, a releasable connection between the sleeve-like part 301 and the closure part 302 comprises a two-part polytetrafluoroethylene (PTFE) compression seal 303, respective halves of the seal 303 being disposed on the peripheral rear edge 301*d* of the shell 301*a* of the sleeve-like part 301 and the peripheral front edge 302*b* of the shell 302*a* of the closure part 302. The two halves of the seal 303 include lip elements having complementary geometry for guiding the halves together into sealing relationship. The seal 303 is substantially gas tight.

With the two parts 301, 302 of the shroud 300 joined together and the peripheral front edge 301*b* of the sleeve-like part 301 positioned in close proximity to the work roll 100 with the gap G there between, there is provided within the shroud 300 an essentially closed space. In this space there is arranged a coolant spray assembly 400, comprising a supply pipe 401 arranged to provide a coolant flow to a manifold 402, which in turn is configured to distribute the coolant to a plurality of spray nozzles 403 via respective valves 404.

When the rolling mill is in use, the spray nozzles 403 apply a coolant spray S, for example a cryogenic liquid such as liquid nitrogen, to the hot work roll 100. During and after the spraying process, the liquid nitrogen tends to evaporate to form gaseous nitrogen, which may eventually be expelled from the outlet 302*h*.

When the work roll 100 is in use, gas in the duct 301*f* in the shell 301*a* of the sleeve-like part 301 (and optionally in the duct 302*f* in the shell 302*a* of the closure part 302) is at a pressure greater than the pressure of the outside air and acts as a gas barrier at the small gap G between the peripheral front edge 301*b* of the sleeve-like part 301 and the rolling surface 101*a* of the work roll 100, thereby preventing outside air from entering the interior of the shroud 300 and preventing cold gas from escaping from the shroud 300. The gas supplied to the duct 301*f* may be warm in order to maintain the outside of the shroud 300 at a temperature which is above the dew point of the outside atmosphere, thereby preventing the formation of condensation on the outside of the shroud 300 which could contaminate the aluminium as it is rolled. The warm gas may be expelled from the duct 301*f* into the gap G at a pressure which is greater both than the pressure of the outside air and the pressure of the gaseous nitrogen in the space inside the shroud 300. Accordingly, the warm gas will provide a gas barrier at the gap G which will both prevent outside air from entering the interior of the shroud 300 and prevent the gaseous nitrogen from escaping through the gap G. This is beneficial because it prevents contamination of the rolled aluminium by moisture contained in the outside air and also ensures the optimum efficiency of the cooling process within the shroud. Thus it will be understood that it is important to ensure that the correct size of the gap G is maintained in order for the gas barrier to work effectively.

Figure 2:
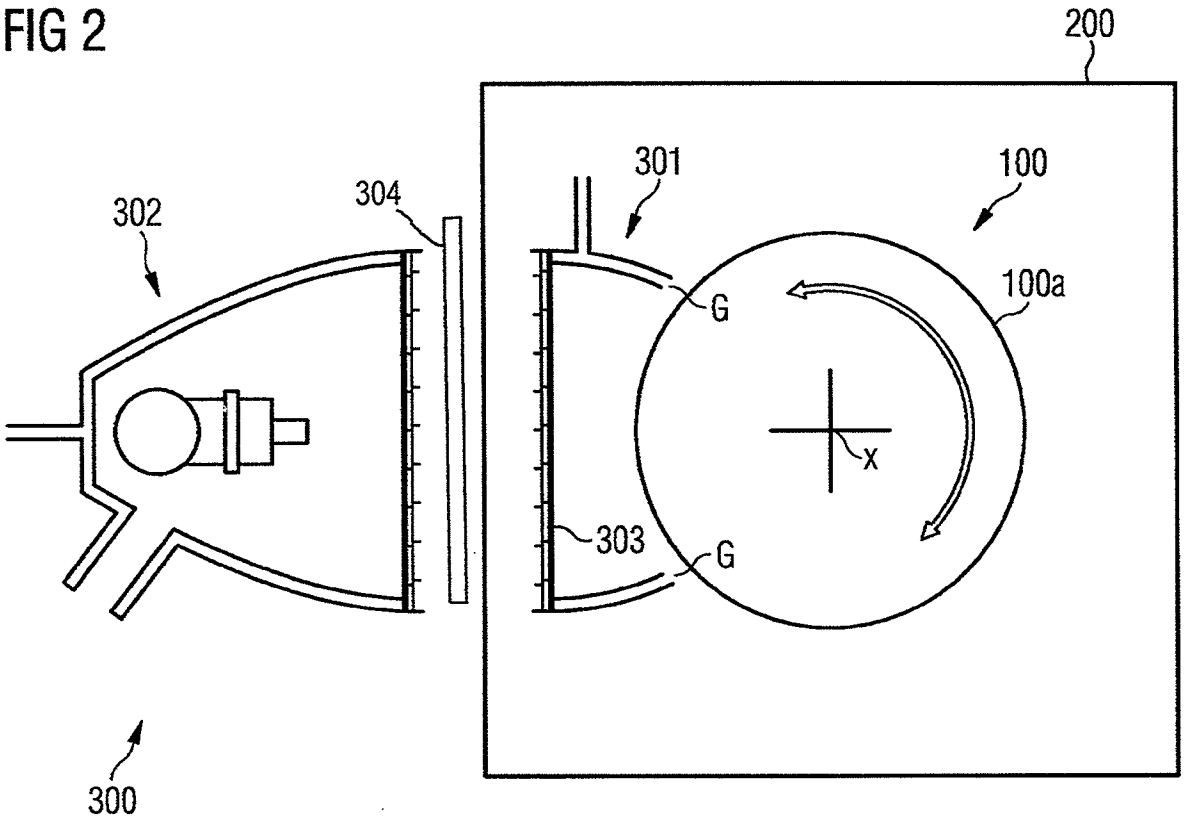
FIG. 2 shows a simplified sectional view of the work roll cooling apparatus of FIG. 1 in a disconnected condition.

Referring now also to FIG. 2, occasionally it is necessary to remove the work roll 100 and chock(s) 200 from the rolling mill 90, for example for routine maintenance or to clean the apparatus. Since the sleeve-like part 301 is mounted to the chock(s) 200 and is detachable from the closure part 302, the work roll 100, chock(s) 200 and sleeve-like part 301 may be axially withdrawn from the rolling mill and the closure part 302. The closure part 302 may remain in place relative to the rolling mill while the work roll 100, chock(s) 200 and sleeve-like part 301 are removed from the rolling mill in a sliding action which separates the two halves of the seal 303. Alternatively, as shown in FIG. 2, the closure part 302 may first be displaced or retracted away from the sleeve-like part 301 (leftwards in the sense of FIG. 2) in order to separate the two parts 301, 302 prior to the axial removal of the work roll 100, chock(s) 200 and sleeve-like part 301 from the rolling mill. The initial retraction of the closure part 302 may make the removal easier because it will then not be necessary to overcome the friction which will otherwise be present between the two halves of the seal 303 as the sleeve-like part 301 is slid axially past the closure part 302.

While the components are removed from the rolling mill for cleaning or maintenance work, the sleeve-like part 301 remains in position relative to the chock(s) 200. Once the work has been completed the work roll 100, chock(s) 200 and sleeve-like part 301 are refitted to the rolling mill 90 using the reverse of the axial motion which was used to remove them, thereby re-establishing the releasable connection between the sleeve-like part 301 and the closure part 302 of the shroud 300. Of course, if the closure part 302 was initially retracted away from the sleeve-like part 301, to enable the removal of the components from the rolling mill, the closure part 302 is moved back toward the sleeve-like part 301 (rightwards in the sense of FIG. 2) in order to reconnect with the sleeve-like part 301.

Since the relationship between the sleeve-like part 301 and the chock(s) 200 has not changed, the size of the gap G between the peripheral front edge 301*b* of the sleeve-like part 301 and the rolling surface 101*a* of the work roll 100 is maintained. Accordingly, an effective gas barrier will be provided the next time the rolling mill is put to use. This is achieved without manual intervention by an operator, thereby saving time and cost.

Thus, it will be seen that the invention provides for the sealing mechanism, between the shroud 300 and work roller 100, to be separated from the rest of the shroud 300 so that the correct performance of the sealing mechanism is assured even after the rolling mill has been disassembled and reassembled, possibly repeatedly, for maintenance or cleaning. Moreover, the detachable connection between the sleeve-like part 301 and the closure part 302 provides that the two parts 301, 302 of the shroud 300 may be separated while the work roll 100 is rotating, for example to facilitate access for cleaning the rotating work roll 100.

It will be understood that the invention has been described in relation to its preferred embodiments and may be modified in many different ways without departing from the scope of the invention as defined by the accompanying claims. For example, the skilled reader will recognise that the chocks need not be rectangular and the shell of the shroud need not be curved, it being possible to configure these items in a wide variety of shapes which could provide the same functions.

In an embodiment, the seal 303 includes a through-portion so that the respective ducts 301*f*, 302*f* of the sleeve-like part 301 and the closure part 302 of the shroud 300 are in communication with one another. Accordingly, gas supplied to the inlet 301*g* at the closure part 302 can pass through the ducts 301*f*, 302*f* to the gap G. In this case, the inlet 301*g* at the sleeve-like part 301 can be omitted.

In an embodiment, the seal 303 is omitted. In this case, the peripheral front edge 302*b* of the shell 302*a* of the closure part 302, and the peripheral rear edge 301*d* of the shell 301*a* of the sleeve-like part 301, are placed in direct contact with one another to provide the releasable connection between the two parts 301, 302 of the shroud 300.

In an embodiment, a separate gas or air knife is provided at the gap G to prevent leakage of gas from the shroud 300. One or both of the ducts 301*f*, 302*f* may be configured to direct gas from the duct to the interior of the shroud 300.

In an embodiment, a removable cover 304 is arranged to fit to the peripheral front edge 302*b* of the closure part 302 of the shroud 300 in order to protect the interior of the closure part 302 from the ingress of dirt, moisture, or other contaminants, when the closure part 302 has been separated from the sleeve-part 301

The invention claimed is:

1. A work roll cooling apparatus for a rolling mill, comprising:

a work roll having a rolling surface;

at least one chock configured to support the work roll in the rolling mill, the work roll which is supported in the chock, having an axis about which the rolling surface is rotatable;

a shroud configured for being positioned adjacent the rolling surface when the work roll is in use supported on the chock so as to provide a cooling space between the shroud and the work surface within which a coolant is brought into contact with the work roll;

the shroud including a first part disposed at a selected location on the chock to provide a predetermined gap between the first part and the rolling surface, a second part at a side of the first part away from the work roll, and a connection for releasably connecting the first and the second parts; and wherein, in a connected condition, the first and the second parts are joined so as to provide and define the cooling space within the shroud, and in a disconnected condition, each of the at least one chock, the first part of the shroud and the work roll may be axially removed from the rolling mill and from the second part of the shroud.

2. A work roll cooling apparatus according to claim 1, wherein the first part of the shroud is disposed on the chock to be in fixed relationship with the work roll when the work roll is in use.

3. A work roll cooling apparatus according to claim 1, wherein the second part of the shroud is configured and arranged to be retracted from the first part, and away from the axis (X) of the work roll, to provide the disconnected condition.

4. A work roll cooling apparatus according to claim 1, wherein the connection comprises a compression seal, a pneumatic seal, or a hydraulic seal.

5. A work roll cooling apparatus according to claim 4, wherein the compression seal, the pneumatic seal, or the hydraulic seal is disposed on the first part, the second part, or both of the first and second parts, of the shroud.

6. A work roll cooling apparatus according to claim 5, wherein the compression seal, the pneumatic seal, or the hydraulic seal is disposed on both of the first and the second parts of the shroud, and wherein the compression seal, the pneumatic seal, or the hydraulic seal has complementary geometry between the first and the second parts configured for guiding the first and the second parts into the connected condition.

7. A work roll cooling apparatus according to claim 1, wherein at least one of the first part or the second part of the shroud includes an exhaust for removing the coolant from the cooling space.

8. A work roll cooling apparatus according to claim 1, wherein the shroud comprises a heating arrangement for maintaining an outside of the shroud above a predetermined temperature.

9. A work roll cooling apparatus according to claim 8, wherein the heating arrangement comprises a duct configured to receive a warming gas and the duct is configured and located and extends to enable the heating gas in that duct to warm the duct.

10. A work roll cooling apparatus according to claim 9, wherein the duct is comprised of the first part, the second part, or both of the first and second parts, of the shroud.

11. A work roll cooling apparatus according to claim 10, wherein the duct is comprised of both of the first and the second parts of the shroud, and the second part includes an inlet for passing the warming gas into the duct from a first outside source.

12. A work roll cooling apparatus according to claim 11, wherein the first part includes an inlet for passing the warming gas into the duct from the first outside source or from a second outside source.

13. A work roll cooling apparatus according to claim 1, including a removable cover which is configured and arranged to prevent contamination of the second part of the shroud when the shroud is in the disconnected condition.

14. A rolling mill, comprising at least one work roll and work roll cooling apparatus according to claim 1.

15. A method of operating a work roll cooling apparatus for a rolling mill, comprising:

configuring at least one chock to support a work roll in the rolling mill, the work roll having an axis about which it is rotatable, supporting the work roll on the chock;

disposing on the at least one chock a first part of a shroud adjacent the work roll so as to provide a predetermined gap between the first part and a surface of the work roll;

axially inserting, along an axis, each of the at least one chock, the first part of the shroud and the work roll into the rolling mill along the axis;

releasably connecting a second part of the shroud to the first part such that the first and the second parts are joined so as to provide a cooling space within the shroud into which a coolant may be brought into contact with the work roll; and axially removing each of the at least one chock, the first part of the shroud and the work roll from the rolling mill and the second part of the shroud.

16. A method of operating a work roll cooling apparatus according to claim 15, wherein the disposing of the at least one chock on the first part of the shroud comprises defining a fixed relationship between the first part and the work roll when in use.

17. A method of operating a work roll cooling apparatus according to claim 15, further comprising axially removing each of the at least one chock, the first part of the shroud and the work roll from the rolling mill and from the second part of the shroud, and the axial removal comprises retracting the second part from the first part in a direction, away from the axis of the work roll.

* * * * *